US005526663A

United States Patent [19]

Sauvonnet et al.

[11] Patent Number: 5,526,663

[45] Date of Patent: Jun. 18, 1996

[54] DEVICES FOR THE GROOVING OF TUBES

[75] Inventors: Jean-Louis Sauvonnet, Villemoirieu; Franck Delavaquerie, Givet, both of France

[73] Assignee: Trefimetaux, Courbevoie, France

[21] Appl. No.: 274,749

[22] Filed: Jul. 14, 1994

[30] Foreign Application Priority Data

Jul. 16, 1993 [FR] France ..... 93 08985

[51] Int. Cl.[6] ..... B21B 27/10

[52] U.S. Cl. ..... 72/43; 72/96; 72/283; 72/75

[58] Field of Search ..... 72/75, 43, 112, 72/283, 68, 96

[56] References Cited

U.S. PATENT DOCUMENTS

| | | | |
|---|---|---|---|
| 4,373,366 | 2/1983 | Tatsumi | 72/283 |
| 4,512,178 | 4/1985 | Blevins et al. | 72/75 |
| 4,712,407 | 12/1987 | Yoshiki et al. . | |
| 4,876,869 | 10/1989 | Saeki et al. . | |

FOREIGN PATENT DOCUMENTS

| | | | |
|---|---|---|---|
| 24349 | 10/1916 | Denmark . | |
| 55-103215 | 8/1980 | Japan . | |
| 56-117827 | 9/1981 | Japan . | |
| 5736016 | 2/1982 | Japan | 72/283 |
| 0187425 | 9/1985 | Japan | 72/283 |
| 0011211 | 1/1990 | Japan | 72/75 |
| 0160110 | 6/1990 | Japan | 72/283 |
| 0071914 | 3/1991 | Japan | 72/283 |
| 5076924 | 3/1993 | Japan | 72/68 |

*Primary Examiner*—Daniel C. Crane
*Assistant Examiner*—Ed Tolan
*Attorney, Agent, or Firm*—Dennison, Meserole, Pollack & Scheiner

[57] ABSTRACT

A device for grooving the internal surface of tubes is disclosed as including a holding die for holding in position inside the tube a floating chuck equipped with a grooved chuck and a grooving unit including a rotating cage for retaining a number of rotating balls for compressing the tube wall against the grooved chuck to form a groove in the tube. The grooving unit includes a finishing die. The rotating cage includes a supporting member of which the internal profile, in an axial section is an arc of a circle, and a cage closure plate for retaining the balls in the cage and further includes a lubricator for the interior of the cage.

18 Claims, 5 Drawing Sheets

DEVICES FOR THE GROOVING OF TUBES

SPHERE OF THE INVENTION

The invention relates to the sphere of grooved tubes usually used as heat exchanger elements in air conditioning units. The invention relates more particularly to the devices for grooving the internal surface of tubes.

PRIOR ART

Devices for grooving tubes, are already known from Japanese applications No. 52-103905 (publication No. 61-59806), No. 5410760 (publication No. 59-12365) and No. 55-19448 (publication No. 56-117827), some of which are mentioned in U.S. Pat. No. 4 373 366.

Generally speaking, these tube grooving devices comprise three elements aligned with the axis of a tube to be grooved:

at the head of the line, a holding die intended to hold in position inside the tube to be grooved a floating chuck equipped with a rod of which the free end carries a grooved chuck, downstream of this holding die (with respect to the direction of the tube to be grooved), a grooving unit comprising a rotating cage surrounding the balls (or elements with an equivalent function) intended to compress the wall of the tube against said grooved chuck so as to form an internally grooved tube, and, downstream of said grooving unit, a finishing die. In this application, the word "cage" denotes the part of the grooving unit which causes the balls to turn round the tube to be grooved by pressing them against the wall of the tube.

PROBLEM POSED

During their work on the internal grooving of tubes, the Applicants experimented with known means, in particular those described in FIG. 2 of Japanese publication No. 55-103215 (or FIG. 2 of U.S. Pat. No. 4 373 366) and made the following observations:

* on the one hand, the ball cage (reference numeral 17 in FIG. 2 of U.S. Pat. No. 4 373 366) does not allow easy introduction of the balls or holding of the balls in position in the absence of a tube to be grooved. In fact, with this type of cage, there is nothing to hold the balls in position in view of the clearance required to introduce them into the cage.
* on the other hand, marking of the cage was observed owing to the pressure of the balls, which led to dimensional variations such that the production of batches of regular quality was difficult to envisage.
* moreover, rapid wear of the balls and deterioration of the cage were noted, probably in connection with the foregoing point.
* finally, in view of the need to change the cage and the balls, the difficulty in carrying out this type of change rapidly was noted.

SUBJECTS OF THE INVENTION

The invention relates to a device which solves the problems set out hereinbefore and also allows high productivity by using an economical device (investment) having a long service life.

GENERAL DESCRIPTION OF THE INVENTION

According to the invention, the device for the grooving of tubes comprises, aligned with the axis of said tube to be grooved, a holding die for intended to hold in position inside said tube to be grooved a floating chuck equipped with a rod of which the free end carries a grooved chuck and, downstream (with respect to the direction of travel of the tube to be grooved) of said holding die, a grooving unit comprising a rotating cage surrounding balls intended to compress the wall of said tube against said grooved chuck so as to form an internally grooved tube and, downstream of said grooving unit, a finishing die, characterised in that a) said cage consists of a supporting member of which the internal profile, in an axial section, comprises an arc of a circle forming a track for the rolling of said balls and of which the radius of curvature is at least equal to that of said balls, and of a closure plate for said cage, b) means for lubricating the contacting surfaces between said balls and said supporting member, between said balls and the external surface of said tube to be grooved, and between said balls themselves.

As will be demonstrated by the examples, the Applicants noted a radical change in all the points mentioned with respect to the problems encountered with the prior art from the moment when they simultaneously employed the two essential features according to the invention, that is on the one hand a cage of which the active member (during grooving) has a particular internal profile inherent in the invention and, on the other hand, lubrication of all the parts inside said cage.

According to the invention, the internal profile partially mates with the curvature of the balls, which is quite different from the prior art, where point contact of the ball/plane type is essentially found. Furthermore, this concept is relatively far removed from the opinion of a skilled person, according to which it is preferable for the balls to have the maximum of freedom of movement so as not to introduce additional coupling (friction) between balls and cage, in view of the high speeds of rotation. In this respect, point contact of the ball/plane type would appear preferable.

Contrary to former beliefs (reduction of the contacts between balls and cage wall), the Applicants have found that, if the balls are well lubricated, ball/cage contact in an arc of a circle and not in a point led to completely different results much better than those obtained with ball/cage contact at a point, as in the prior art.

Figure 1:
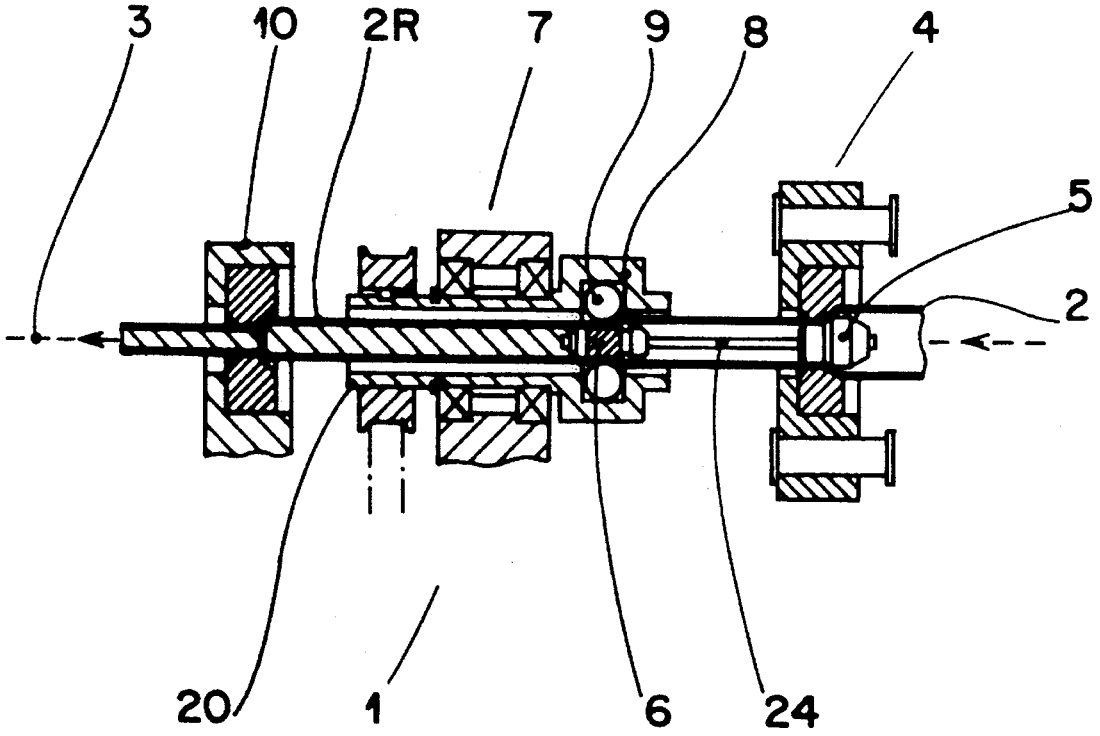
FIG. 1 shows a device 1 for the grooving of a tube 2 to be grooved according to the prior art (FIG. 2 of U.S. Pat. No. 4,373,366 with reference numerals which have been modified so as to be uniform with those of the present application). This device comprises, from upstream to downstream (see direction of the arrow on the axis 3), aligned with the axis 3 of the tube.

* a holding die 4 which holds the floating chuck 5,
* a grooving unit 7 which comprises a rotating cage 8 with balls 9-the balls pressing the tube to be grooved on a grooved chuck 6 held at a constant distance from the floating chuck 5 by means of the rod 24—integral with a shaft 20 held in position by ballbearings (without reference numerals) and set into rotation by a pulley (without a reference numeral) on the downstream portion of said grooving unit 7;
* a finishing die 10 downstream of the grooving unit.

Figure 2A:
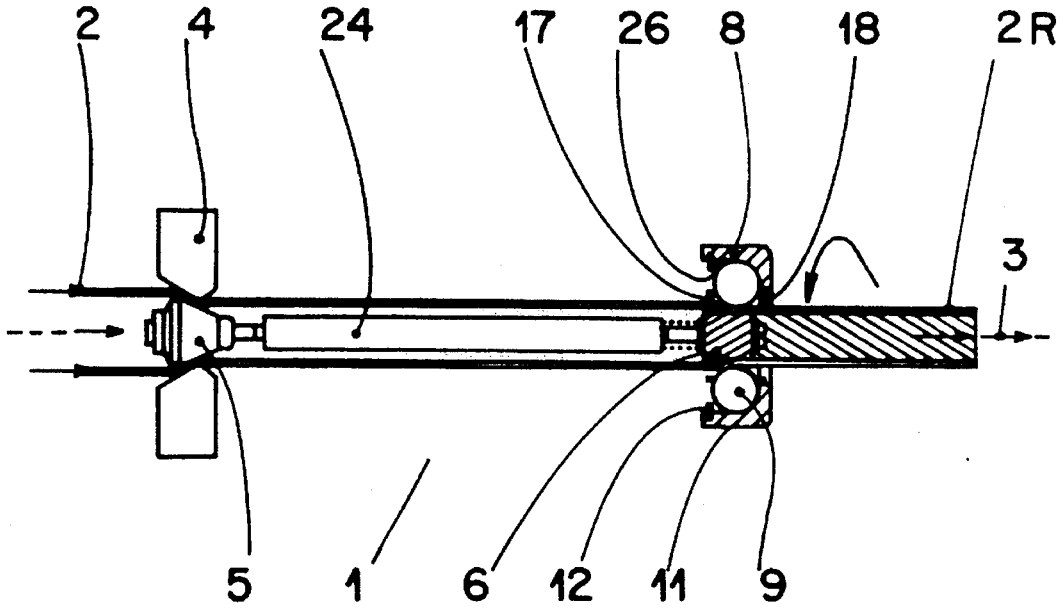
Figure 2B:
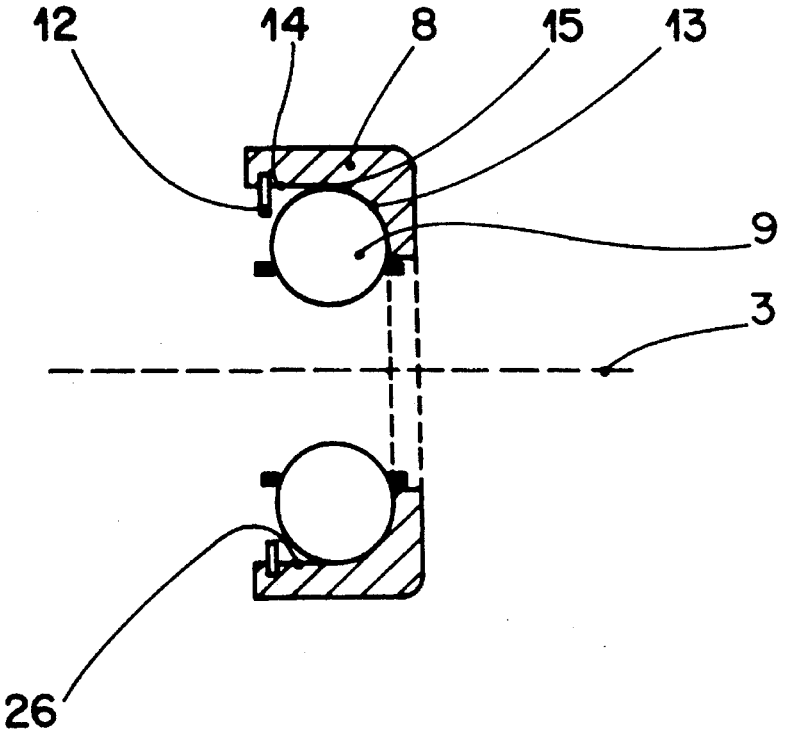

FIGS. 2*a* and 2*b* show a rotating cage 8 according to the invention in an axial section. In FIG. 2*a*, the cage 8 is shown with the holding die 4 and the grooving chuck 6. FIG. 2*b* shows an enlargement of the cage and of the balls in FIG. 2*a*. These Figures do not show the shaft 20 allowing rotation of the cage 8, the downstream finishing die 10 or the means permitting lubrication of the interior of the rotating cage 8.

Figure 3:
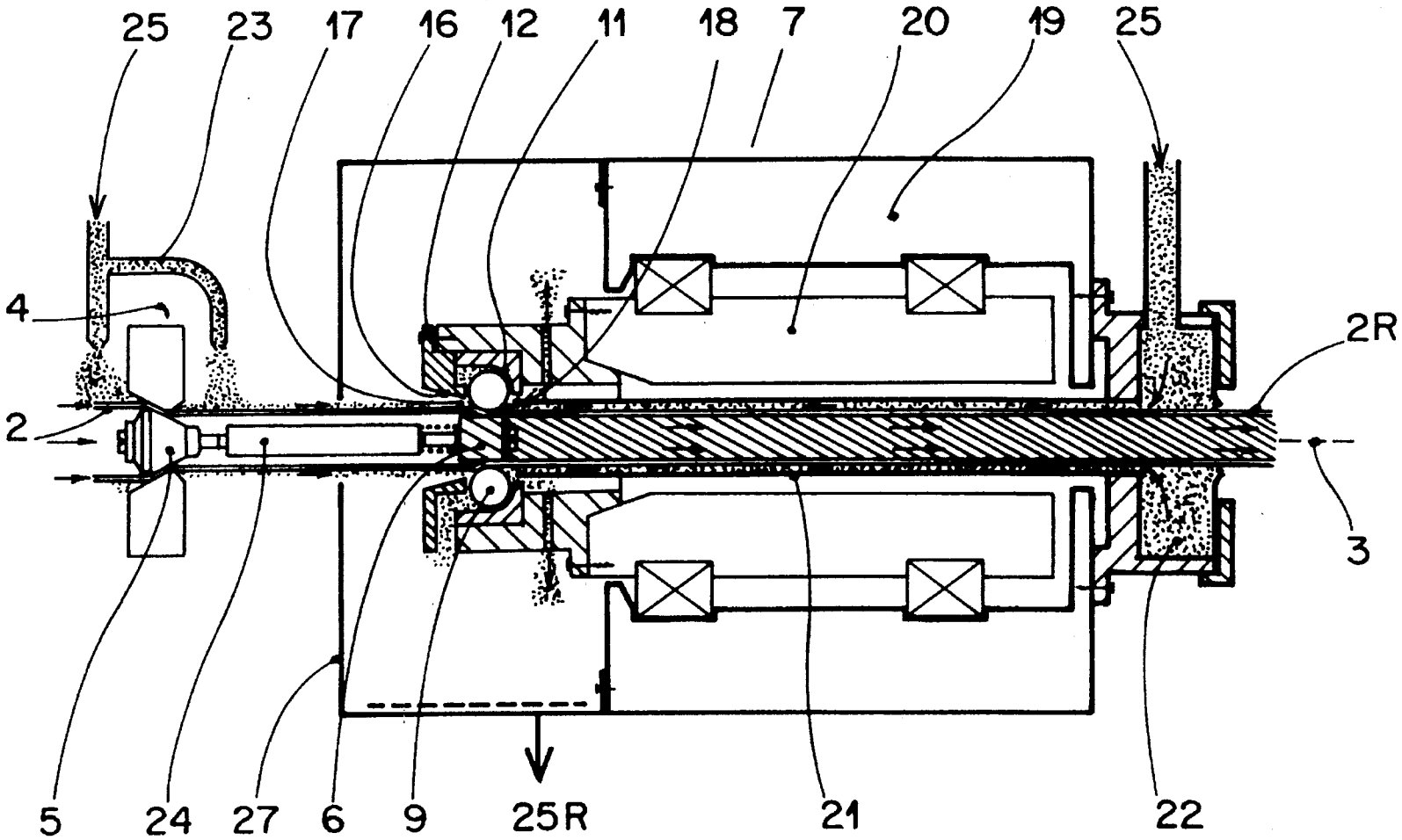

FIG. 3 is an axial section through a complete grooving unit 7 according to the invention and through the holding die 4 equipped with means 23 for introducing a lubricant 25 upstream and downstream of the holding die. The stationary members of the grooving unit 7 are shown in thick lines and the rotating members in a fine line.

Stationary members: the electromagnetic spindle 19, the device 22 for lubricating the interior of the cage 8 which comprises a tube 21 coaxially supplying lubricant 25 to the downstream base 18 of said balls 9 as well as a housing 27 allowing recovery of the lubricant 25R to be discharged or recycled.

Rotating members: the shaft 20 which carries, at its upstream end, the rotating cage 8 is equipped with a closure plate 12 mounted axially on the supporting member 11. The plate 12 is perforated in places to allow the radial discharge of the lubricant 25 circulating in the cage 8 under the influence of the centrifugal force.

Figure 4A:
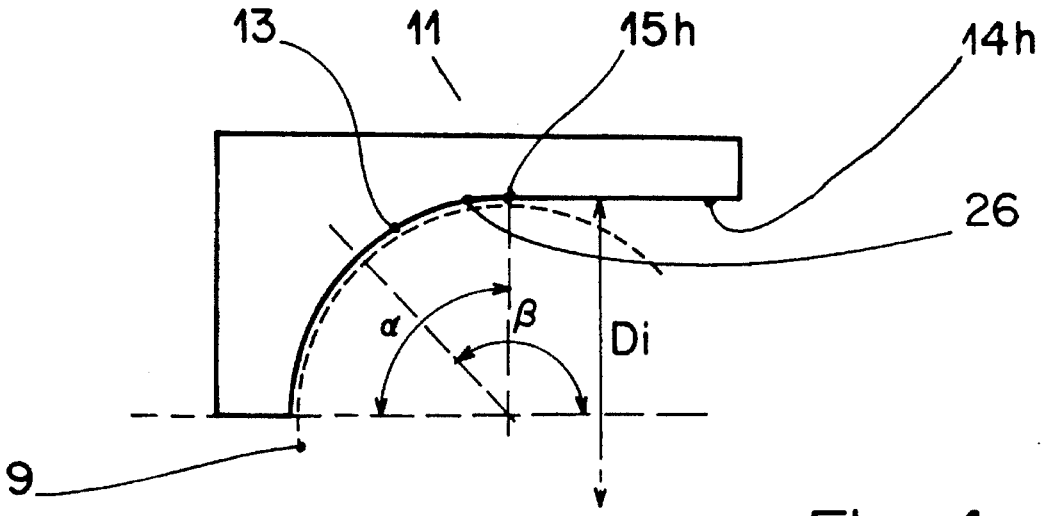
Figure 4B:
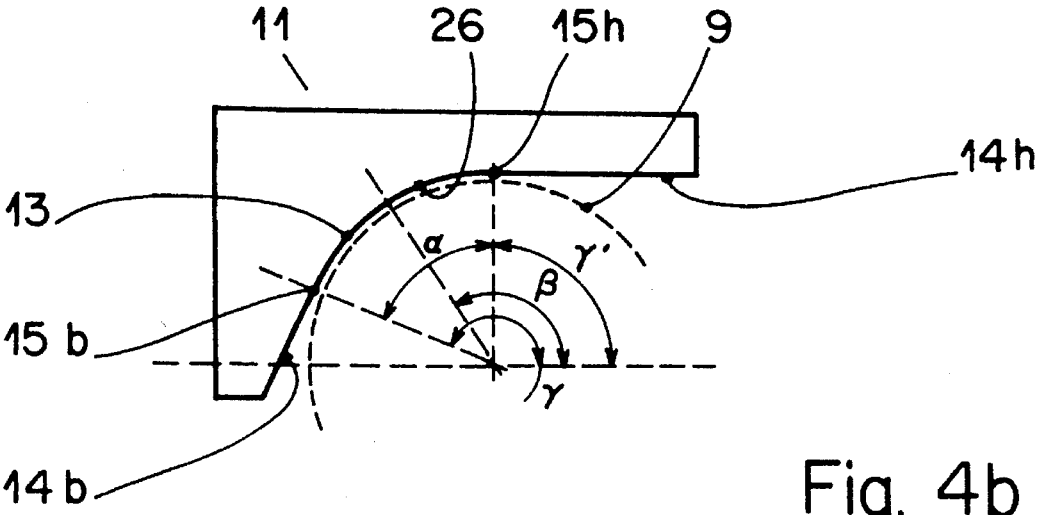
Figure 4C:
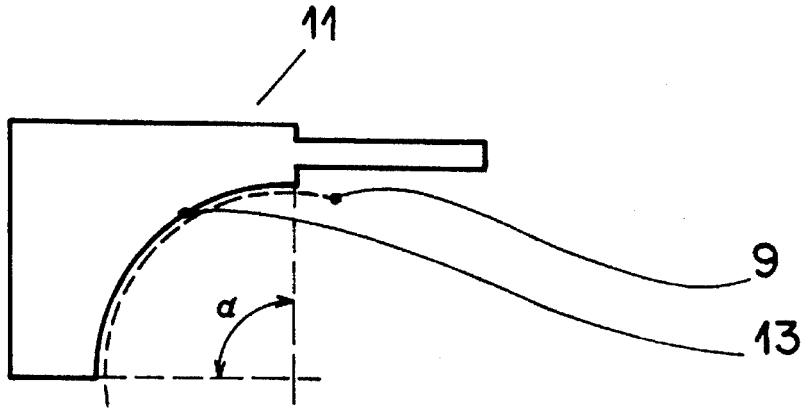

FIGS. 4*a* to 4*c* show, in an axial half section, three embodiments of the invention of internal profile 26 of supporting members 11. In FIG. 4*a*, the profile 26 consists of an arc of a circle 13 tangentially connected at a "high" point 15*h* to a straight segment 14*h*. In this case, the angle alpha is 90° and the angle beta (angle of the bisector of angle alpha relative to the oriented axis 3) is 135°.

In FIG. 4*b*, the profile 26 consists of an arc of a circle 13 tangentially connected at a "high" point 15*h* to a straight Segment 14*h* and at a "low" point 15*b* to a straight segment 14*b*. In this case, the angle alpha is 70° and the angle beta 125°. The angle gamma (angular co-ordinate of one end of said arc of a circle) is 160° and the angle gamma' (angular co-ordinate of the other end of said arc of a circle) is 90°.

In FIG. 4*c* the profile 26 consists only of an arc of a circle 13 having an angle alpha equal to 90°. In this case, the supporting member 11 is equipped with bolts enabling the closure plate 12 to be reversibly fixed.

Figure 5:
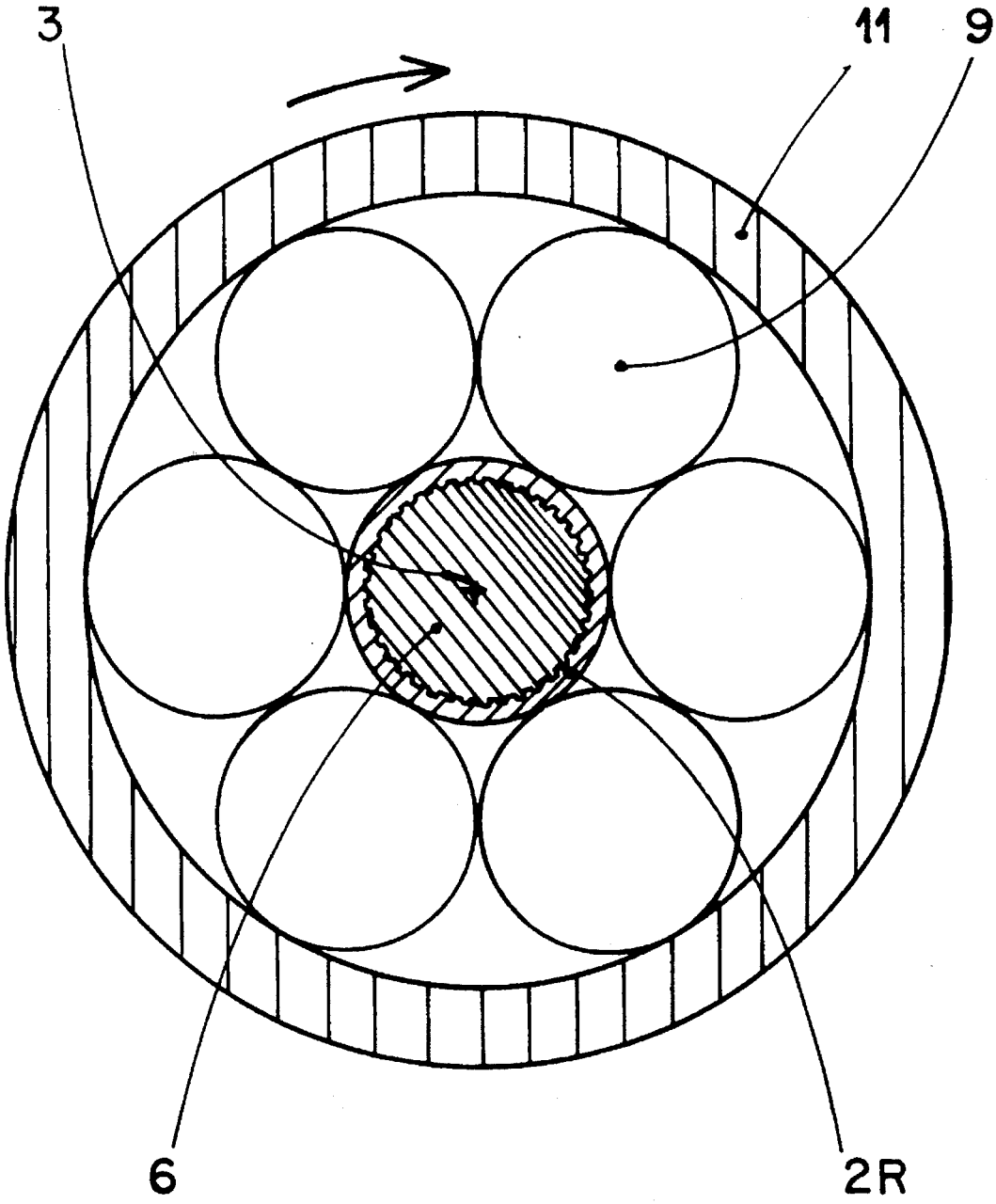

FIG. 5 shows the interior of the grooving cage in a section perpendicularly to the axis 3 in the case of six balls (shown tangentially to one another for the convenience of construction).

DETAILED DESCRIPTION OF THE INVENTION

In order to transmit to said balls 9 a rotational movement and a compressive stress by pressure over an arc of a circle, not at a point as in the prior art, said arc of a circle 13 and said balls have close radii of curvature. The term "close" denotes that the radius of curvature of the balls is at most 5% smaller than that of said arc of a circle.

Although it is possible to have, according to the invention, an internal profile 26 without straight segments, as shown in FIG. 4*c*, it is preferable for said internal profile 26 to comprise at least one tangential connection between one end of said arc of a circle 13 and one straight segment (14*h* and/or 14*b*).

Said internal profile 26 preferably comprises a so-called "high" tangential connection 15*h* between said arc of a circle 13 and a Straight segment 14*h* parallel to said axis 3, as shown in FIGS. 4*a* and 4*b* so as to impose predetermined axial spacing on said balls 9 and to form so to speak a cage with a cylindrical wall which is convenient for installation and removal of the cage, ensuring the mechanical stability of the supporting member even at a very high speed of rotation and contributing to the production of grooved tubes having stable geometric characteristics.

Said internal profile 26 can comprise a so-called "low" tangential connection 15*b* between said arc of a circle 13 and a straight segment 14*b* forming with said axis 3 an angle between 45° and 90° and preferably between 70° and 90°. A connection of this type creates a wedge-shaped space at the downstream base of the balls which can facilitate the flow of lubricant 25 carried by the tube 21 to the downstream base 18 of balls, between the balls 9 and the internal surface of said supporting member 11.

According to the invention said arc of a circle 13 has a span (angle alpha) of between 40° and 90°, the angle of its bisector with said axis (angle beta) being selected so as to correspond substantially to the resultant of the stresses of said balls against said supporting member 11 for a given speed of travel of said tube 2 and the given speed of rotation of said rotating cage 8. In fact, it is important for the arc of a circle 13, which is also substantially the curve of contact between balls and internal surface of said supporting member 11, not to be too small, otherwise the problems of the prior art (marking of the cage, rapid wear, etc.) are encountered, nor too great, which would lead to excessive guidance of the balls (loss of a degree of freedom in the radial direction with an angle gamma greater than 180° loss of a degree of freedom in the axial direction with an angle gamma' smaller than 90°).

It is in fact desirable according to the invention for the balls to have a degree of freedom in the axial direction and this is why said closure plate 12 connected to said supporting member 11 allows the balls 9 axial play typically of a few mm.

Similarly, it has been found preferable for said balls to have total freedom in the sense of an absence of mechanical connection in the radial direction, though this would not be the case with angles gamma >180° (angle gamma and gamma'=angular coordinates of said arc of a circle—see FIG. 4*b*). In fact, the results are less good (faster wear) if the profile of the interior of the cage mechanically limits the degrees of freedom of the balls, as in the case of a ballbearing cage.

The second essential feature of the invention concerns the lubrication of the balls and of the interior of said supporting member 11. In particular, it is important according to the invention that said means for lubricating the contacting surfaces continuously allow lubrication of the downstream base 18 of the balls so that lubricant is constantly interposed between balls and the internal surface of said supporting member 11, between balls and the tube to be grooved and between the balls themselves.

Said grooving unit comprises an electromagnetic or mechanical stationary rotating spindle 19 setting into rotation a shaft 20 connected to said cage 8 located at the upstream end of said shaft 20 (with respect to the direction of travel of said tube). Said supply of lubricant to the downstream base of said balls is obtained by means of a device 22 for lubricating said cage 8 comprising a co-axial stationary tube 21 having a diameter between the external diameter of said tube after grooving 2R and the internal diameter of said shaft 20, the tube being supplied with lubricant at its downstream end, its upstream end being located at a short distance (typically a few mm) from the downstream base 18 of said balls 9. See FIG. 3.

The tube is preferably supplied with lubricant at ambient temperature (but it could optionally be cooled) at a variable flow rate depending on the grooving conditions (speed of rotation of the cage and speed of travel of the tube) but generally at a flow rate which also allows the lubricant to act as a coolant for the balls and the cage.

It is preferable for said lubricating means also to comprise a supply of lubricant to the upstream base 17 of said balls 9.

For this purpose, it is preferable if said supply of lubricant to the upstream base 17 of said balls is obtained by means of a device 23 for lubricating said holding die 4 upstream and downstream thereof, so that the tube 2 penetrates the grooving unit with a lubricated external surface.

It is also desirable according to the invention to select, for a given external diameter De of the grooved tube 2R, an internal diameter Di of the cylindrical part of the interior of said cage 8 (active member of said supporting member—see FIG. 4*a*) a number n and a diameter Db of balls such that said balls 9 are in a small number (of the order of 5 to 8 with conventional tubes), roll in said cage 8 with slight clearance from one another (at most equal to 1 mm) so as only to be able to leave said cage axially (after removal of said plate 12) and not radially. In the limit case of zero clearance between balls, this satisfies, between Db, De, Di and n, the equation arc sine Db/Di=180/n, wherein Di=De+2 Db. See FIG. 5.

According to the invention, said closure plate 12 of said cage 8 is selected so that said balls cannot leave said supporting member 11 in the upstream axial direction so that it is easy to connect said plate 12 to said supporting member or to separate it therefrom and to facilitate the circulation of lubricant in said cage. This is why said plate has perforated or grooved portions, as may be deduced from FIG. 3.

As already pointed out, the closure plate 12 allows the balls a certain amount of axial play. However, it should be noted that, owing to the aforementioned geometric conditions (choice of a small number of balls of appropriate diameter), the balls remain in said cage 8 even in the absence of a tube, even in the absence of a plate, and this is highly convenient in practice since the inspection or change of balls, the change of said rotating cage are very simple and take only a few minutes.

The materials of the balls and of the cage—in particular of supporting member 11—are not specific to the invention. They are generally steel-based hard materials, but any material which is only deformed slightly under stress, a material made of an alloy other than a steel alloy or of ceramic material could also be used.

With regard to the dimensions of the device according to the invention, they are typically linked to the diameter of the tube to be grooved, as demonstrated by mere examination of FIG. 5 which shows that, in the cage of a cage having six balls, the external diameter De of the grooved tube is substantially equal to the diameter Db of the balls, the internal diameter Di of the cylindrical part of said cage thus being equal to 3De=3Db.

The device according to the invention is adapted to the grooving of tubes of which the diameter De can typically range from 3 mm to 30 mm or more.

EXAMPLES

FIGS. 2 to 5 describe embodiments of devices according to the invention. During their investigations, the Applicants have carried out numerous comparative grooving tests, all other things being equal (copper tubes (Cub1 grade) having a final external diameter of 9.52 mm, cages with six steel balls measuring 9.50 mm to 9.60 mm depending on the thickness of the tube and the weight/m intended for the grooved tube, speed of rotation=30,000 rpm, speed of travel of the tube=30 m/min). Typically, the tube had an external diameter of 10.60 mm just upstream of the grooving unit and a diameter of 9.60 mm just downstream of the grooving unit.

These tests concerned, in particular, the following two points:

Factor A=shape of the cage according to 2 embodiments:

A1=according to the invention (FIGS. 2*a* and 2*b*)

A2=according to the modified prior art (cage according to FIG. 1—but with a plate to allow convenient introduction of the balls and to allow work with six balls)

Factor B=lubrication of the balls and of the interior of the cage according to 3 embodiments:

B1=upstream and downstream lubrication according to the invention

B2=upstream lubrication of the balls

B3=without lubrication

The following tests were carried out (coupling of factors A and B) :

| | Factor A | |
|---|---|---|
| Factor B | A1 | A2 |
| B1 | Test 11 | Test 21 |
| B2 | Test 12 | Test 22 |
| B3 | Test 13 | Test 23 |

For each test, the development of the device (wear of the balls and of the cage) was examined and the service life of the device was evaluated and, on the other hand, the product obtained and the evolution of its characteristics during the test were examined. The results have been evaluated qualitatively:

Results obtained:

| | Wear of balls and cage | Variations in the dimensions of the tube |
|---|---|---|
| Test 11 | very slight wear | very slight variation |
| Test 12 | medium wear | slight variation |
| Test 13 | rapid scoring | — |
| Test 21 | marking of the cage<br>ovalisation of the balls | medium variation |
| Test 22 | marking of the cage<br>> test 21<br>ovalisation of the balls | medium variation<br>> test 21 |
| Test 23 | very pronounced wear<br>metal stripping | prnounced variation |

Complementary tests and investigations allowed evaluation of the quantity of tubes that the "ball plus cage" assembly can produce while maintaining dimensions within the standard dimensional tolerances:

test 11: about 10 t, that is about 100 km of tube test 21: about 1 t test 23 : about 200 kg Further tests:

The speed of travel with the various devices was also compared and it was found that, in the case of the device from test 11, very high speeds of travel could be attained, typically higher than 70 m/min and at least 30% higher than that permitted by the device from test 22 or test 21.

It is therefore obvious that the combination of the essential features of the invention leads to results which are far superior to those allowed by prior art devices.

ADVANTAGES OF THE INVENTION

The invention has numerous advantages over the prior art, of which the majority have already been mentioned but will be listed below:

* simplicity of the device according to the invention, in particular of the rotating cage, which is translated into reasonable investment and maintenance costs (no adjustment of the cage to be made);
* ease of installation and removal of the cage and the balls: an installation operation (assembly of balls/cage/shaft) or removal operation lasts about 5 minutes (ease of inspection of the cage). To be compared with the difficulty of installation with a device according to FIG. 1 (prior art);
* long service life of the cage and the balls: supporting member 11 and balls to be changed after about 10 t of production, compared with the change after 1 t with the device according to the prior art;

ease of installation/removal which also allows a rapid change of the balls (change of diameter) if the characteristics of the grooved tube (weight/m, wall thickness) are to be maintained with a different starting tube or, conversely, if the characteristics of the grooved tube (weight/m, wall thickness) are to be modified while keeping the same starting tube;

* production of constant quality (stability of the geometric characteristics) over the 10 t whereas variations appear very rapidly with the prior art devices;
* cage of small dimensions, therefore of low inertia, permitted by the device according to the invention, allowing speeds of rotation which can attain 45,000 rpm with current technology and with tubes having an external diameter of 9.52 mm (higher speeds of rotation can be attained with smaller diameter tubes), which is favourable for high productivity;
* productivity: at least 30% higher than that permitted by a prior art device.

Finally, the device according to the invention represents the ideal solution to all the problems encountered by a skilled person who is grooving tubes using prior art devices.

We claim:

1. Device (1) for the grooving of an interior surface of a wall of a tube (2) moving longitudinally and comprising, in alignment with a longitudinal axis (3) of the tube to be grooved (2), a holding die (4) for holding in position inside the tube to be grooved (2) a floating chuck (5) equipped with a rod (24) having a free end of which the free end carries a grooved chuck (6), downstream of said holding die (4) with respect to the direction of travel of the tube to be grooved a grooving unit (7) comprising a rotating cage (8) configured to surround a plurality of balls (9) for compressing the wall of the tube (2) against said grooved chuck (6) so as to form an internally grooved tube (2R) and, downstream of said grooving unit, a finishing die (10), wherein a) said cage (8) being open facing longitudinal movement of the tube into the grooving device, said cage comprising a supporting member (11) for rolling reception of said plurality of balls said supporting member having an internal profile (26) which in axial section comprises an arc of a circle (13) forming a circular track for the rolling reception of said plurality of balls, a radius of curvature of said circular track being at least equal to a radius of curvature of said balls, said radius of curvature being oriented to allow for the axial movement of said balls within said cage, and a removable closure plate (12) for the opening of said cage for releasably retaining said balls in said cage, and b) means for lubricating contacting surfaces between said balls (9) and said supporting member (11) between said balls (9) and the external surface of the tube to be grooved (2), and between said balls themselves.

2. Device according to claim 1, in which, to transmit a rotational movement and a compressive stress by support over an arc of a circle to said balls (9), said arc of a circle (13) and said balls have close radii of curvature wherein a radius of curvature of the balls is at most 5% smaller than that of said arc of a circle.

3. Device according to claim 2, in which said internal profile (26) comprises at least one tangential connection between one end of said arc of a circle (13) and a straight segment (**14*h***), said straight segment permitting said axial movement of said balls.

4. Device according to claim 3, in which said straight segment is a segment (**14*h*) parallel to said axis (3) so as to impose predetermined axial spacing on said balls (9), which straight segment is connected tangentially to said arc of circle (13) at an upper tangential point (15*h***).

5. Device according to claim 3, in which said internal profile (26) comprises a tangential connection (**15*b*) between said arc of a circle (13) and a straight segment (14*b*) forming an angle of between 45° and 90° preferably with said axis (3**).

6. Device according to claim 1, in which said arc of a circle (13) has a span of between 40° and 90°, the angle of its bisector with said axis, angle beta, being selected so as to correspond substantially to the resultant of the stresses of said balls against said supporting member (11) for a given speed of travel of said tube (2) and a given speed of rotation of said rotating cage (8).

7. Device according to claim 1, in which said lubricating means comprise a supply of lubricant to the downstream base (18) of said balls (9).

8. Device according to claim 7, in which said lubricating means comprise a supply of lubricant to the upstream base (17) of said balls (9).

9. Device according to claim 1, in which said grooving unit comprises an electromagnetic or mechanical stationary rotating spindle (19) setting into rotation a shaft (20) connected at one of its ends to said cage (8).

10. Device according to claim 9, in which said cage (8) is located at the upstream end of said shaft (20), with respect to the direction of travel of said tube, and in which said supply of lubricant to the downstream base of said balls is obtained by means of a device (22) for lubricating said cage (8) comprising a co-axial stationary tube (21) having a diameter between the external diameter of said tube after grooving and the internal diameter of said shaft, the tube being supplied with lubricant at its downstream end, its upstream end being located at a short distance (typically a few mm) from the downstream base (18) of said balls (9).

11. Device according to claim 8, in which said supply of lubricant to the upstream base (17) of said balls is obtained by means of a device (23) for lubricating said holding die (4) upstream and downstream thereof.

12. Device according to claim 1, in which said balls (9), of diameter Db, roll in said cage (8) with slight clearance from one another, at most equal to 1 mm, satisfying, in view of the internal diameter Di of the active member of said supporting member (11), the external diameter De of the grooved tube (2R) and the number of balls n, the equation arc sine Db/Di =180/n, wherein Di=De+2 Db in the case of zero clearance between balls.

13. Device according to claim 1, in which said closure plate (12) of said cage (8) is sized so as to prevent said balls from leaving said supporting member (11) in the upstream axial direction so that said plate (12) is easy to connect to said bearing member or to separate from it to facilitate the circulation of lubricant in said cage.

14. Device according to claim 3 in which said internal profile (26) comprises a tangential connection (**15*b*) between said arc of a circle (13) and another segment (14*b*) forming an angle of between 70° and 90° with said axis (3**).

15. Device (1) for the grooving of tube(s) (2) comprising, aligned with the axis (3) of said tube to be grooved (2), a holding die (4) intended to hold in position inside said tube to be grooved (2) a floating chuck (5) equipped with a rod (24) of which the free end carries a grooved chuck (6) and, downstream, with respect to the direction of travel of the tube to be grooved, of said holding die (4) a grooving unit (7) comprising a rotating cage (8) surrounding balls (9) intended to compress the wall of said tube (2) against said grooved chuck (6) so as to form an internally grooved tube (2R) and, downstream of said grooving unit, a finishing die (10), characterised in that a) said cage (8) consists of a supporting member (11) of which the internal profile (26), in an axial section, comprises an arc of a circle (13) forming a track for the rolling of said balls and of which the radius of curvature is at least equal to that of said balls, and of a closure plate (12) for said cage, b) means for lubricating the contacting surfaces between said balls (9) and said supporting member (11), between said balls (9) and the external surface of said tube to be grooved (2), and between said balls themselves, wherein to transmit a rotational movement and a compressive stress by support over an arc of a circle to said balls (9), said arc of a circle (13) and said balls have close radii of curvature a radius of curvature of the balls being at most 5% smaller than that of said arc of a circle, said internal profile (26) comprises at least one tangential connection between one end of said arc of a circle (13) and a straight segment, and wherein said internal profile (26) comprises a tangential connection (**15*b*) between said arc of a circle (13) and a straight segment (14*b*) forming an angle of between 45° and 90° with said axis (3**).

16. Device (1) for the grooving of tube(s) (2) comprising, aligned with the axis (3) of said tube to be grooved (2), a holding die (4) intended to hold in position inside said tube to be grooved (2) a floating chuck (5) equipped with a rod (24) of which the free end carries a grooved chuck (6) and, downstream, with respect to the direction of travel of the tube to be grooved, of said holding die (4) a grooving unit (7) comprising a rotating cage (8) surrounding balls (9) intended to compress the wall of said tube (2) against said grooved chuck (6) so as to form an internally grooved tube (2R) and, downstream of said grooving unit, a finishing die (10), characterised in that a) said cage (8) consists of a supporting member (11) of which the internal profile (26), in an axial section, comprises an arc of a circle (13) forming a track for the rolling of said balls and of which the radius of curvature is at least equal to that of said balls, and of a closure plate (12) for said cage, wherein said grooving unit comprises an electromagnetic or mechanical stationary rotating spindle (19) setting into rotation a shaft (20) connected at one of its ends to said cage (8), wherein said cage (8) is located at the upstream end of said shaft (20), with respect to the direction of travel of said tube, and in which said supply of lubricant to the downstream base of said balls is obtained by means of a device (22) for lubricating said cage (8) comprising a co-axial stationary tube (21) having a diameter between the external diameter of said tube after grooving and the internal diameter of said shaft, the tube being supplied with lubricant at its downstream end, its upstream end being located at a short distance from the downstream base (18) of said balls (9).

17. Device (1) for the grooving of tube(s) (2) comprising, aligned with the axis (3) of said tube to be grooved (2), a holding die (4) intended to hold in position inside said tube to be grooved (2) a floating chuck (5) equipped with a rod (24) of which the free end carries a grooved chuck (6) and, downstream, with respect to the direction of travel of the tube to be grooved, of said holding die (4) a grooving unit (7) comprising a rotating cage (8) surrounding balls (9) intended to compress the wall of said tube (2) against said grooved chuck (6) so as to form an internally grooved tube (2R) and, downstream of said grooving unit, a finishing die (10), characterised in that a) said cage (8) consists of a supporting member (11) of which the internal profile (26), in an axial section, comprises an arc of a circle (13) forming a track for the rolling of said balls and of which the radius of curvature is at least equal to that of said balls, and of a closure plate (12) for said cage, and wherein said balls (9), of diameter Db, roll in said cage (8) with slight clearance from one another satisfying, in view of the internal diameter Di of the active member of said supporting member (11), the external diameter De of the grooved tube (2R) and the number of balls n, the equation arc sine Db/Di=180/n, wherein Di=De+2 Db in the case of zero clearance between balls.

18. Device (1) for the grooving of tube(s) (2) comprising, aligned with the axis (3) of said tube to be grooved (2), a holding die (4) intended to hold in position inside said tube to be grooved (2) a floating chuck (5) equipped with a rod (24) of which the free end carries a grooved chuck (6) and, downstream, with respect to the direction of travel of the tube to be grooved, of said holding die (4) a grooving unit (7) comprising a rotating cage (8) surrounding balls (9) intended to compress the wall of said tube (2) against said grooved chuck (6) so as to form an internally grooved tube (2R) and, downstream of said grooving unit, a finishing die (10), characterised in that a) said cage (8) consists of a supporting member (11) of which the internal profile (26), in an axial section, comprises an arc of a circle (13) forming a track for the rolling of said balls and of which the radius of curvature is at least equal to that of said balls, and of a closure plate (12) for said cage, and wherein said closure plate (12) of said cage (8) is selected to prevent said balls from leaving said supporting member (11) in the upstream axial direction so that said plate (12) is easy to connect to said bearing member or to separate from it to facilitate the circulation of lubricant in said cage.

* * * * *